US008920938B2

(12) United States Patent
Hesse et al.

(10) Patent No.: US 8,920,938 B2
(45) Date of Patent: Dec. 30, 2014

(54) FLAT PRODUCT COMPOSED OF A METAL MATERIAL, IN PARTICULAR A STEEL MATERIAL, USE OF SUCH FLAT PRODUCT AND ROLLER AND PROCESS FOR PRODUCING SUCH FLAT PRODUCTS

(75) Inventors: Bodo Hesse, Dinslaken (DE); Karl-Heinz Kopplin, Essen (DE); Folkert Schulze-Kraasch, Duisburg (DE); Udo Schulokat, Dinslaken (DE); Hans-Gerd Weyen, Moers (DE); Ingo Rogner, Ingolstadt (DE); Torsten Herles, Dinslaken (DE); Roland Meier, Holzwickede (DE)

(73) Assignees: ThyssenKrupp Steel Europe AG, Duisburg (DE); Walzen-Service-Center GmbH, Oberhausen (DE)

( * ) Notice: Subject to any disclaimer, the term of this patent is extended or adjusted under 35 U.S.C. 154(b) by 1095 days.

(21) Appl. No.: 12/663,809

(22) PCT Filed: Jun. 20, 2008

(86) PCT No.: PCT/EP2008/057873
§ 371 (c)(1),
(2), (4) Date: Nov. 10, 2010

(87) PCT Pub. No.: WO2009/000771
PCT Pub. Date: Dec. 31, 2008

(65) Prior Publication Data

US 2011/0165430 A1 Jul. 7, 2011

(30) Foreign Application Priority Data

Jun. 22, 2007 (EP) ..... 07110866

(51) Int. Cl.
*B32B 15/04* (2006.01)
*B32B 15/18* (2006.01)

(Continued)

(52) U.S. Cl.
CPC ..... *B21B 27/005* (2013.01); *B21B 2261/14* (2013.01);

(Continued)

(58) Field of Classification Search
CPC ..... B32B 3/00; B32B 3/26; B32B 3/30; B32B 15/01; B32B 15/04; B32B 15/18
USPC ..... 428/573, 687, 574, 141, 600, 626, 457, 428/624, 658, 659, 684, 685
See application file for complete search history.

(56) References Cited

U.S. PATENT DOCUMENTS

| | | | |
|---|---|---|---|
| 4,798,772 | A | 1/1989 | Furukawa |
| 2005/0227594 | A1 | 10/2005 | Vinke et al. |

FOREIGN PATENT DOCUMENTS

| | | |
|---|---|---|
| EP | 1584396 | 10/2005 |
| JP | 63050488 | 3/1988 |
| JP | 01293907 | 11/1989 |

OTHER PUBLICATIONS

De Mare C., et al., "Development of the Sibetex Sheet Having Excellent Drawability and Paint Appearance," Cahiers D'Informations Techniques De La Revue De Metallurgie, Revue De Metallurgie, Paris, FR., Bd 94, Nr. 6, Jun. 1997, Seiten 827-836, XP000701846, ISSN: 0035-1563, das ganze Dokument.

(Continued)

*Primary Examiner* — Michael E La Villa
(74) *Attorney, Agent, or Firm* — The Webb Law

(57) ABSTRACT

With the invention a metallic flat product can be systematically made available with such a fine, stochastic or quasi-stochastic surface texture that after a typical automotive paint application it is only minimally perceptible, if at all, by the human eye. At the same time, in the case of a surface topography constituted according to the invention, the transition between the peak plateaus and the valleys takes place via steep flanks. In this way, it is achieved that the morphology of the sheet metal surface is practically independent of the actual depth of the valleys. As a result therefore, the morphology of the sheet metal surface of a metallic flat product according to the invention is also independent of the skin-pass rate, which is obtained when the fine metal texture is produced by skin-pass rolling.

7 Claims, 8 Drawing Sheets

Height illustration with a skin-pass rate of 0.9 %

(51) Int. Cl.

| | |
|---|---|
| ***B32B 3/30*** | (2006.01) |
| ***B21B 27/00*** | (2006.01) |
| ***B21B 1/00*** | (2006.01) |
| ***B21B 1/22*** | (2006.01) |
| ***B21H 8/02*** | (2006.01) |

(52) U.S. Cl.

CPC ..... *B21B 1/227* (2013.01); *B21B 2267/10* (2013.01)

USPC ..... 428/687; 428/141; 428/626; 428/659; 428/684; 492/1; 492/30; 492/37; 72/199; 72/252.5

(56) References Cited

OTHER PUBLICATIONS

Pawelski O., et al., "Einfluss Unterschiedlicher Arbeitswalzen-Aufrauhverfahren Auf Die Oberflaechenfeinstruktur Beim Nachwalzen Von Karosserieblechen," Stahl Und Eisen, Verlag Stahleisen, Dusseldorf, DE, Bd. 114, Nr. 6, Jun. 13, 1994, Seiten 183-188, 305, XP000448210 ISSN: 0340-4803, das ganze Dokument.

International Search Report for International Application No. PCT/EP2008/057873, (Sep. 2008).

Henning Meier, Concerning the roughening of roll surfaces with spark discharges, Shaker Verlag, 1999, Germany, ISBN 3-8265-6112-0, ISSN 0945-0718.

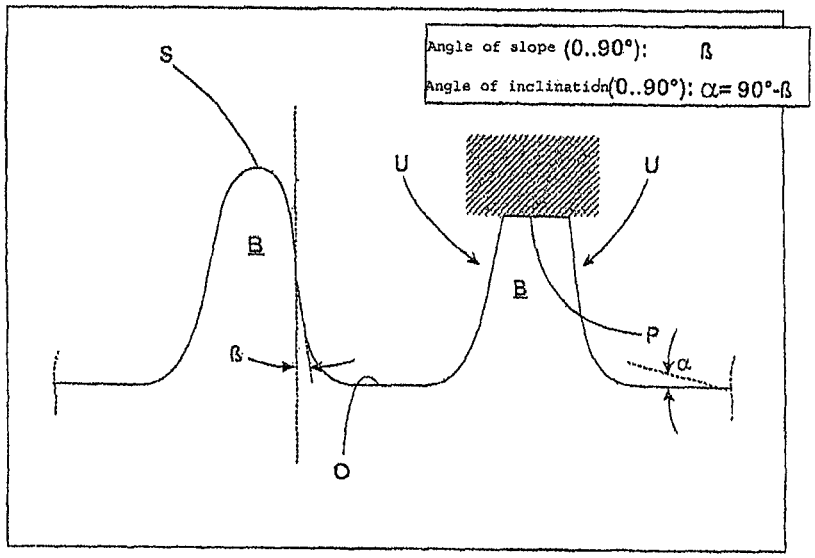

Fig. 1 Schematic illustration of material removal after roll-texturing (grinding off summits S in order to produce transitions U with steep slope angles β between the plateaus P of the "peaks" B and the soles O of the "valleys")

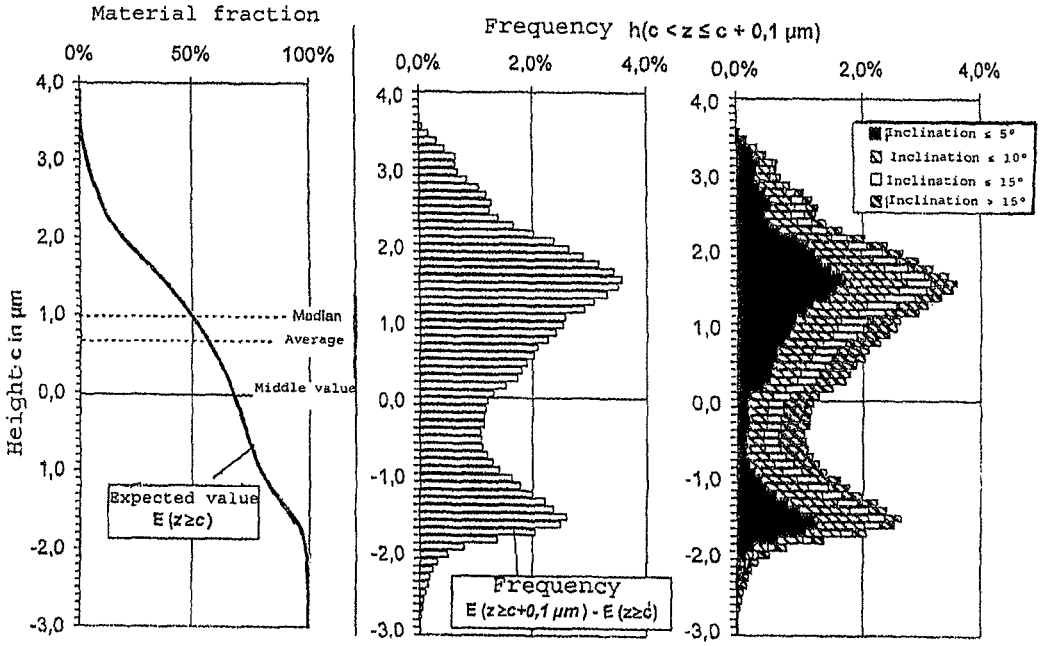

Fig. 2a Fig. 2b Fig. 2c

Evaluation using the example of a sheet metal surface of premium quality

Fig. 2a) Material fraction (Abbott Firestone curve)

Fig. 2b) Frequency of the height values (height distribution) as "derivation" of the Abbott Firestone curve Fig. 2c) Frequency of the height values divided into different classes of angles of inclination (morphological height distribution)

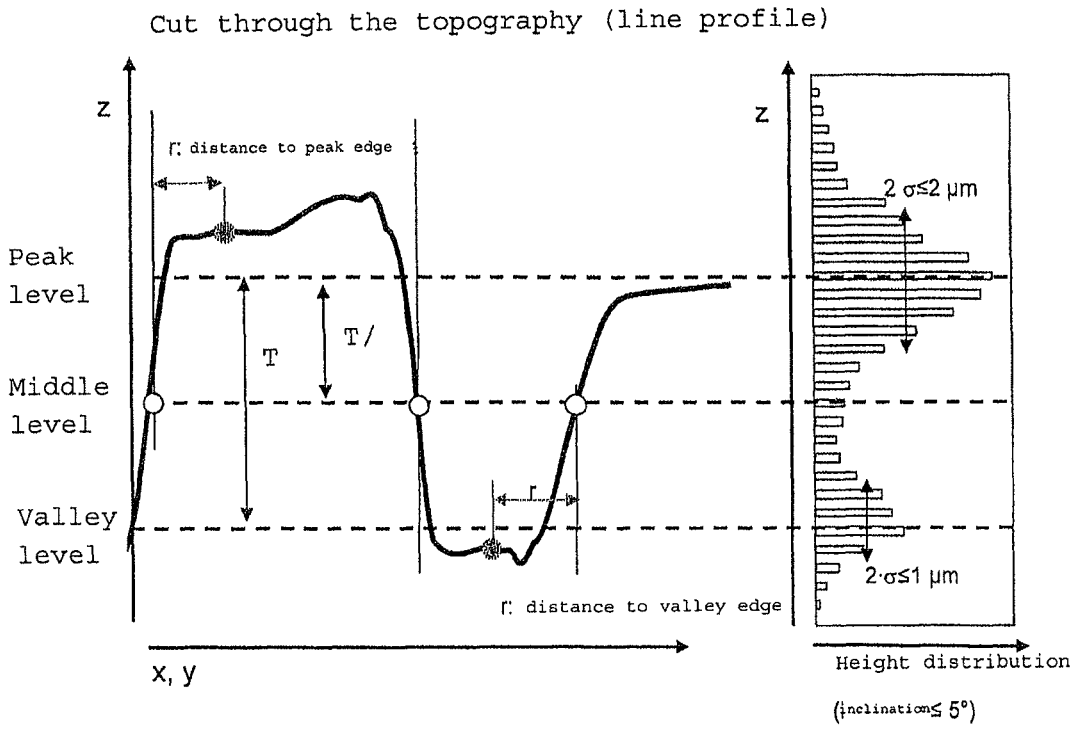

Fig. 3 Schematic diagram relating to topographical / morphological characteristics Evaluation of the peak or valley values (inclination)

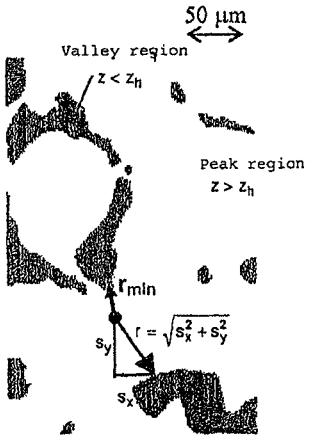

Profile cut through middle level

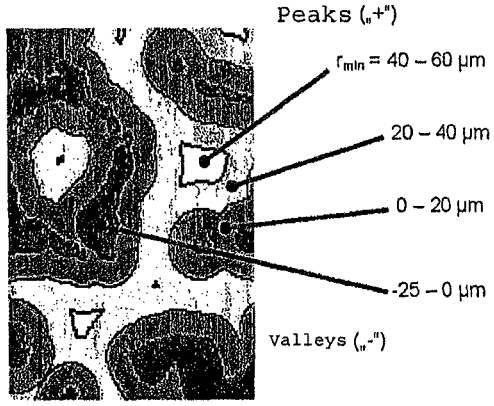

Mapping: $r_{min}$ to the profile line for each topographical point

Fig 4a

Profile cut and schematic diagram for calculating the distance $r_{min}$ to the profile line

Fig. 4b

Surface distribution (mapping) of the distance $r_{min}$ (x, y) using the example of a sheet steel surface according to the invention

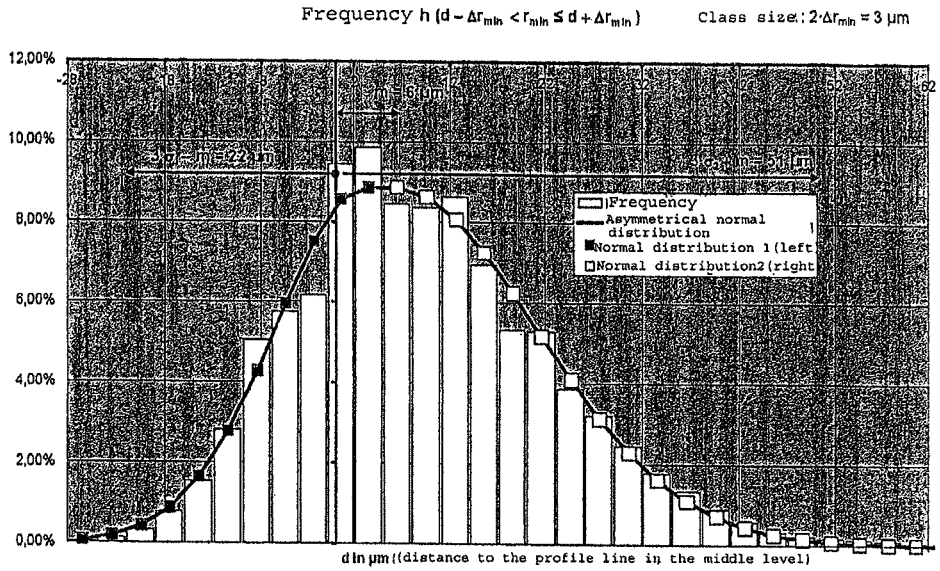
Fig. 5 Frequency distribution of the distance $r_{min}$ to the profile line (middle level); classes of the frequency distribution are marked with "d"; the class size amounts to 3 µm
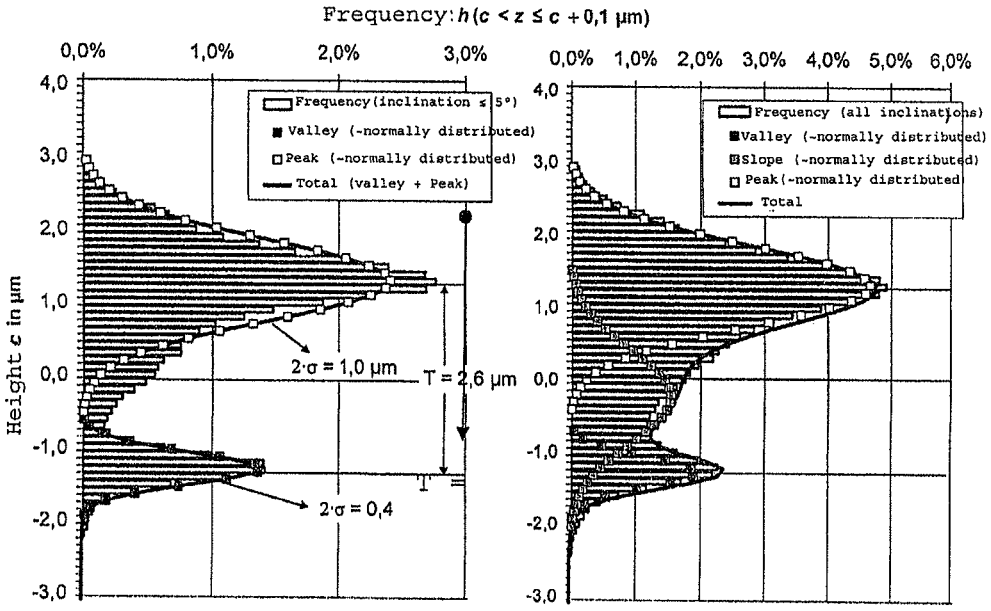
Fig. 6 Height distribution with a skin-pass rate of 0.6 %
(left: only angles of inclination less than 5°, right: all angles of inclination)

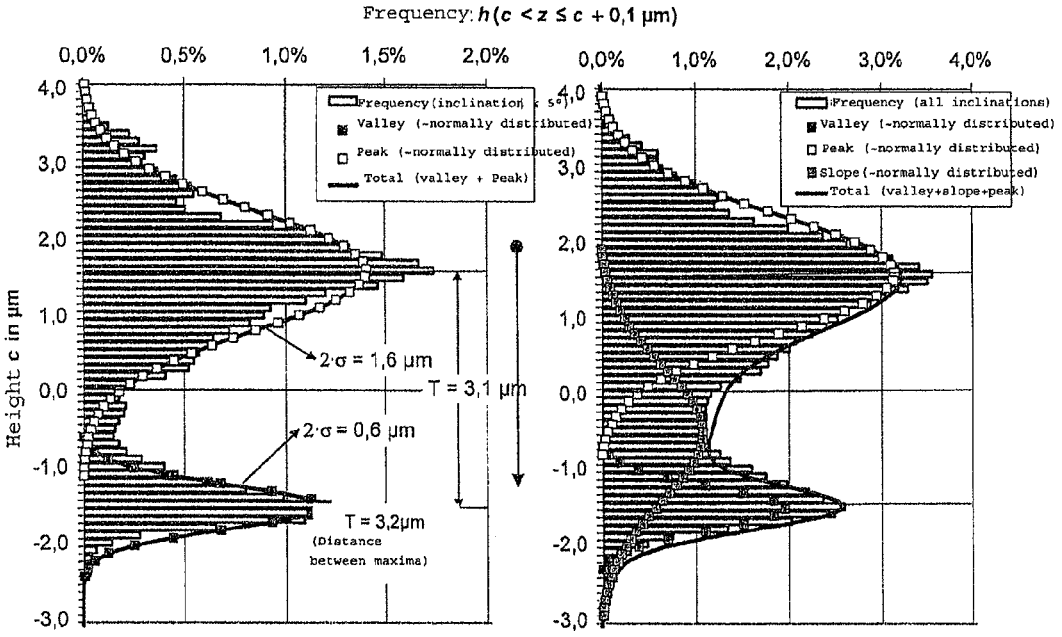
Fig. 7 Height distribution with a skin-pass rate of 0.9 %
(left: only angles of inclination less than 5°, right: all angles of inclination)
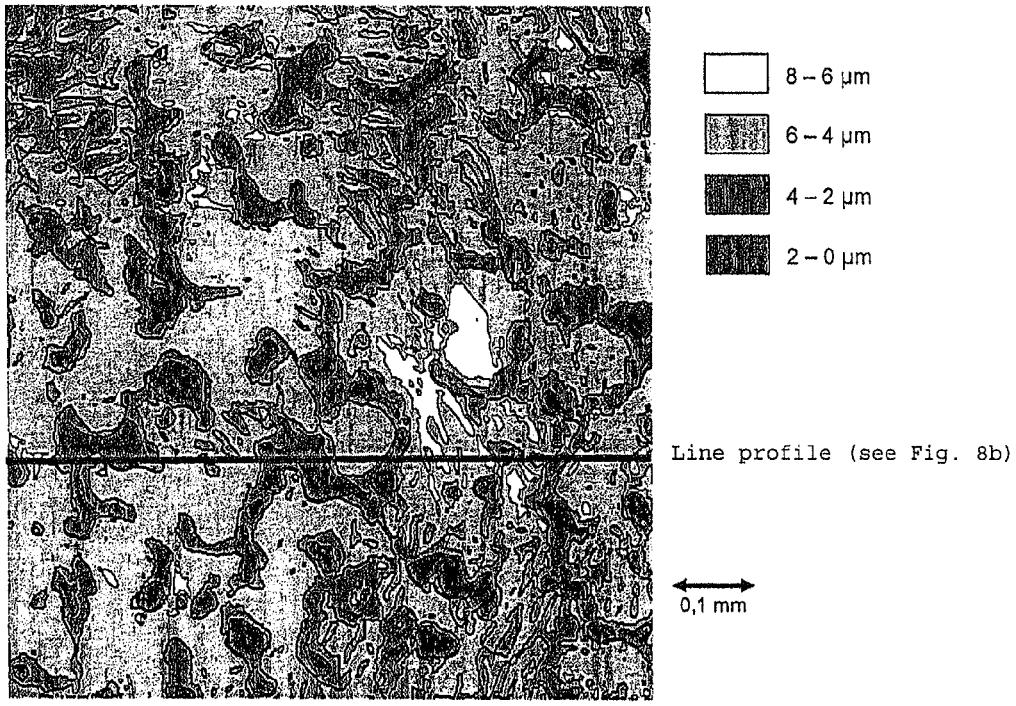
Fig. 8a Height illustration with a skin-pass rate of 0.9 %

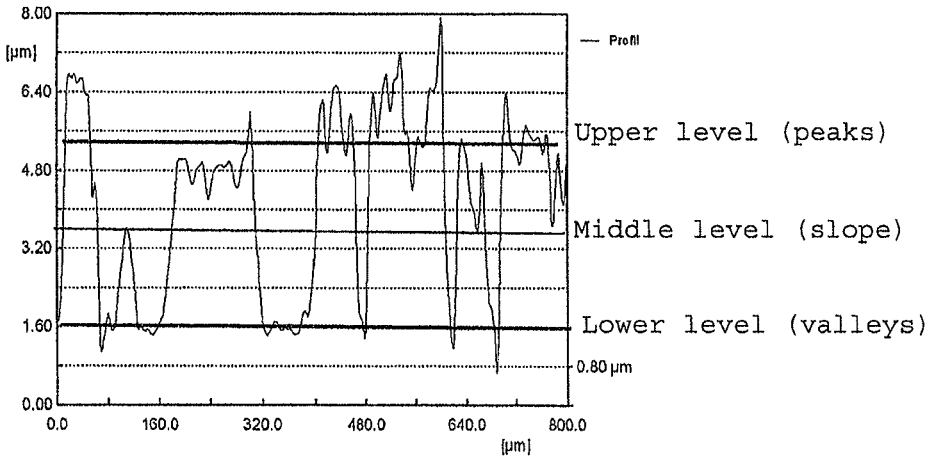
Fig. 8b line profile
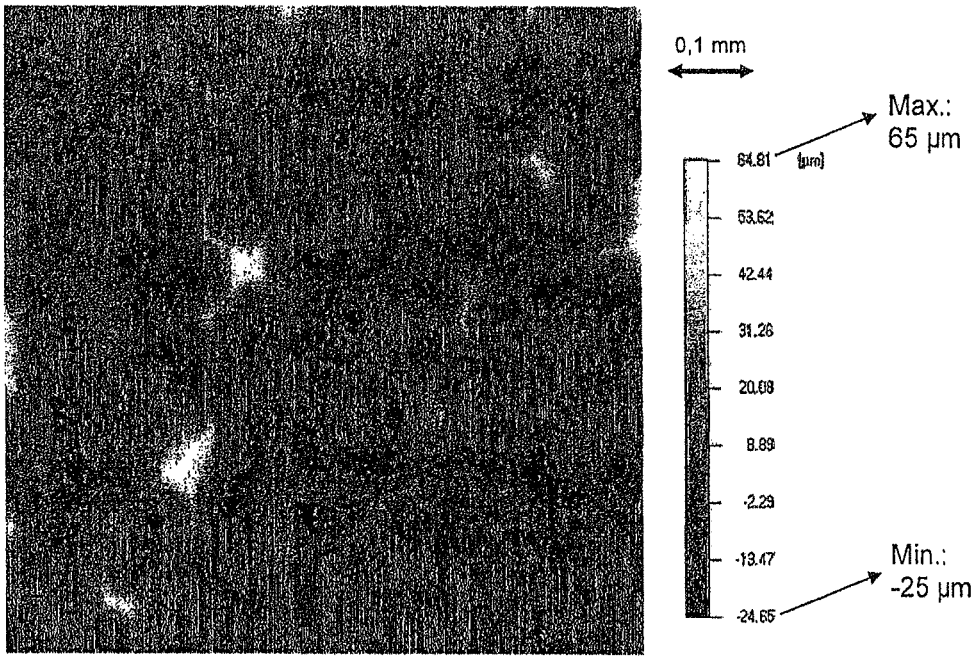
Fig. 9 Typical distance mapping $r_{min}$ in the middle level ("half width") - premium sheet metal (EDT and SF, skin-pass rate = 0.9 %)

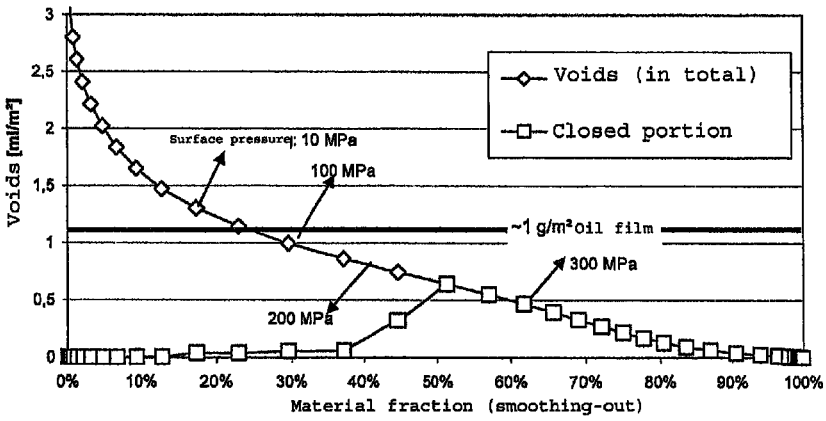
Fig. 10 Smoothing-out behaviour of a sheet metal surface according to the invention
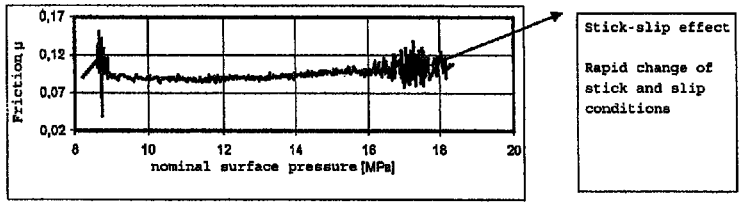
Fig. 11 Forming behaviour with insufficient oil film (1 g/m2), open voids (Fig. 10) are not filled sufficiently
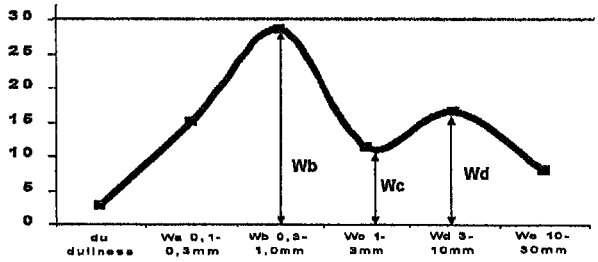
Fig. 12 Structural spectrum of a good paint finish (master curve)

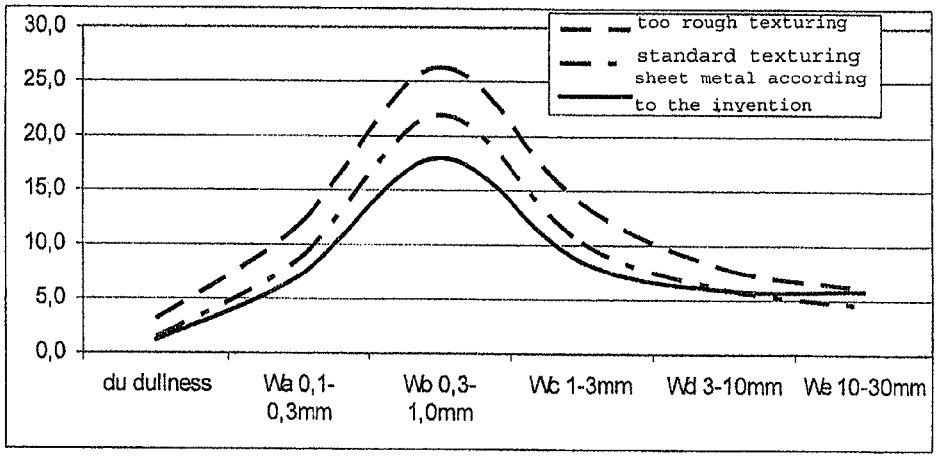
Fig. 13 Comparison of the appearance of the paint finish as a function of the surface texture
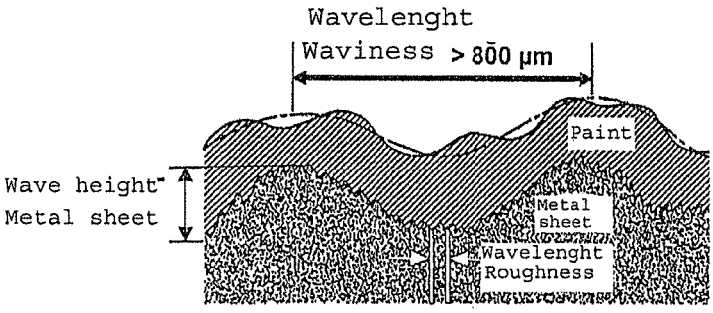
Fig. 14 Connection between sheet metal surface structure and topcoat surface structure
(in accordance with Keiji Nishimura, Iron and Steel Engineer, August 1991)

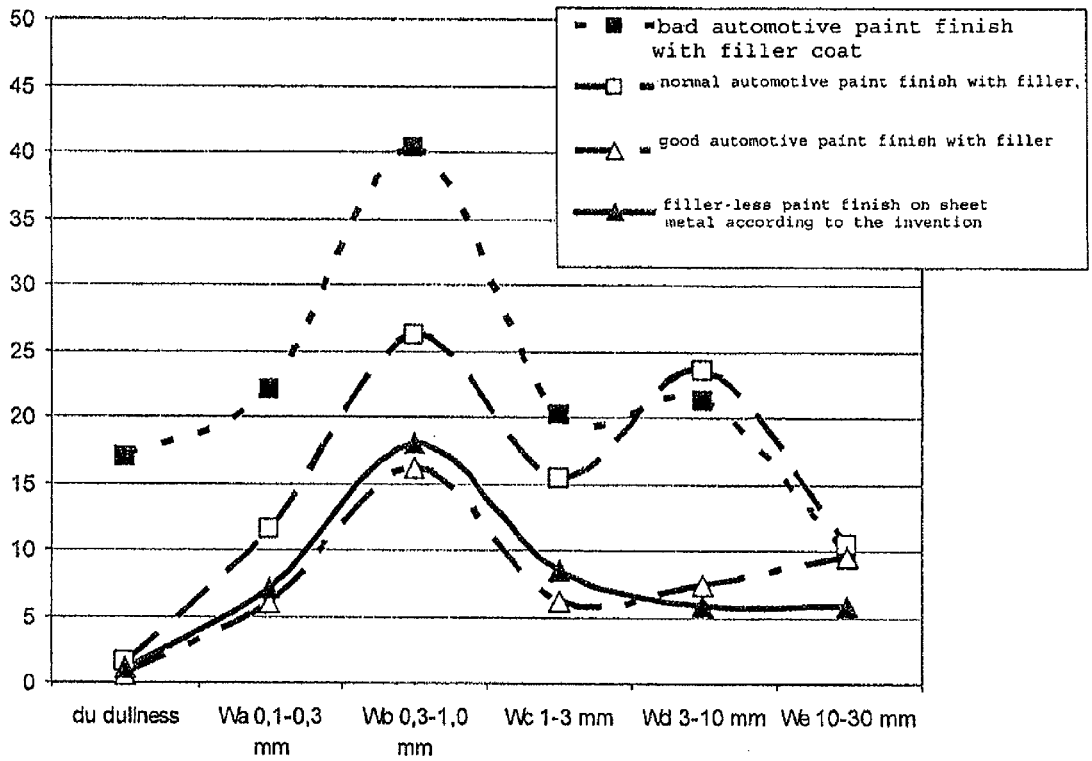
Fig. 15 Structural spectrum: Comparison of various automotive finishes on conventional sheet metal (with outer skin quality) and filler-less automotive paint finish on flat product according to the invention

FLAT PRODUCT COMPOSED OF A METAL MATERIAL, IN PARTICULAR A STEEL MATERIAL, USE OF SUCH FLAT PRODUCT AND ROLLER AND PROCESS FOR PRODUCING SUCH FLAT PRODUCTS

CROSS REFERENCE TO RELATED APPLICATIONS

This application is a National Phase Application of International Application No. PCT/EP2008/057873, filed on Jun. 20, 2008, which claims the benefit of and priority to European patent application no. EP 07 110 866.6, filed on Jun. 22, 2007. The disclosures of the above applications are incorporated herein by reference in their entirety.

FIELD OF THE INVENTION

The invention relates to a flat product made of a metal material, in particular a steel material, an advantageous use and a roll particularly suitable for producing such a flat product as well as a method for producing such flat products. "Flat products" in this context are understood to mean sheets made of metal or a metal alloy, in particular thin sheets, or strip and other rolled products of comparable quality.

BACKGROUND

Components are made from flat products of the type discussed here, which are subsequently coated with one or multiple coats of paint, in order to protect them on the one hand from possible corrosion and on the other hand to optimize their visual appearance. The quality of the visual appearance is judged in this case among other things by how far the surface texture of the respective metal substrate affects the surface of the paint finish.

Particularly high demands are placed on the appearance of the surface of automotive body panels visible from the outside.

In practice, the demands made on the paint finishing of body components are met by the application of multi-coat paint systems. These paint systems usually comprise at least one so-called "filler coat", whose object among other things consists of adjusting any unevenness, which might exist on the surface to be coated.

The cost associated with the application of multi-coat paint systems onto sheet metal is substantial. Modern painting processes achieve cost savings by omitting the filler coat. These processes are being used more and more by the automotive industry. In this case, the total thickness of the paint system is substantially reduced, so that the metal substrate could show up in the finish of unsatisfactory sheet metal.

A further criterion for assessing the suitability of a metallic flat product for producing body components is its behaviour when formed into the respective component. Also, this is crucially influenced by the surface texture of the respective flat product. Thus, the cavities existing on the surface of a metal sheet, during deep-drawing for example, form pockets, in which a lubricant applied onto the metal sheet before its forming or injected into the respective die can accumulate. The load-bearing capacity of the lubricating film formed by the respective lubricant in this case directly depends on the configuration and distribution of these cavities.

Various attempts to structure the surface of metal sheets so that after paint finishing they possess an optimized appearance are known. Examples of these attempts are indicated in Japanese Patents JP-A 63-50488 and JP-A 1-293907.

The regular surface textures described in these two publications of Japanese patent applications are characterized by cylindrical, punch-type elevations, which are encircled by a groove-like recess and project from an otherwise even surface.

In accordance with JP-A 63-50488, the plateaus of the peaks are located approximately 2-10 μm above the soles of the valley regions existing between the elevations. At the same time the combined percentage of even plateaus of the peaks and even surfaces of the average flat regions existing between the soles of the valleys and the peak plateaus amounts to 20-90% of the total surface area.

In JP-A 1-293907, it is also stipulated that the percentage of flat regions between the regularly arranged peaks with circular cross section should assume at least 85% of the sheet metal surface, that the depth of the valleys surrounding the peaks extending from the flat regions should amount to at least 4 μm and, according to a frequency analysis of the sheet steel surface geometry, the intensity of the wavelength portions of the wavelengths $\lambda$, which lie in a range of 585 μm$<\lambda<$2730 μm amounts to 0.6 μm2 at the most.

The metal sheets constituted in accordance with the two Japanese patent applications, in the painted state, are to leave behind an extremely vivid impression. However, the requirements preordained for this presuppose strictly deterministic surface textures. More particularly, the high intensities, permissible according to JP-A 1-293907, in the wavelength portions specified there, only arise in the case of deterministic structures with high periodicity.

In practice, however, it is evident that regular surface textures, obtained in accordance with the prior art described above, can only be produced with the necessary reliability under difficulty. This applies especially if the substrate to be processed concerns galvanized sheet steel.

SUMMARY OF THE INVENTION

With this background, an aspect of the invention is to create a flat product, offering optimized pre-conditions for a paint finish, which has an outstanding appearance, even with thinner paint films, in the finally painted state. Furthermore, a preferred use of such a flat product, a roll, which is particularly suitable for producing such a flat product and a method for producing such a flat product should be indicated.

With regard to the flat product this aspect is achieved according to a flat product made of a metal material having a surface in accordance with an embodiment of the invention. Specifically, over a basic area of at least 0.8×0.8 mm$^2$, the surface of the product, after removing a possible slope in the basic area's topography, filtering out high frequency portions by means of a Gaussian low-pass filter ($\lambda s$=10 μm) and determining a frequency distribution of the height values with a class size of 0.1 μm, the following applies:

a) the frequency distribution of the height values has two pronounced maxima, which equate to correspondingly pronounced peak and valley levels of the surface;
b) when just those topography regions, which have a slope of 5° at the most in relation to the basic area (horizontal) are observed, the frequency distribution of the height values resolve into at least two local main maxima; which local main maxima are substantially normally distributed with a standard deviation (width) of $2\sigma<2$ μm (peaks) and a width of $2\sigma<1$ μm (valleys);
c) frequency of peaks is greater than frequency of valleys;
d) an upper main maximum representing the peaks at the same time is also an absolute maximum;

e) a distance between the maxima of the frequency distribution of the height values amounts to 1 μm-5 μm; and f) on a level, which lies exactly midway between peak and valley level, half the width of the valleys or peaks amounts to 40 μm or 100 μm at the most, wherein at least 99.99% of topography measurement points possess a minimum distance to the edge of the valleys or peaks, which fulfils this condition.

Due to their special characteristic profile, flat products according to the invention can be used particularly for producing components, which are to be provided with a paint coating. This applies especially if the products according to the invention consist of steel and in particular are provided with a corrosion protective layer, for example galvanizing. Such steel sheet can be coated, for example, with a zinc or zinc magnesium coating. However, the criteria specified according to the invention can also apply to flat products which are made of other metals.

In particular, flat products according to the invention are suitable for producing car body components. After their shaping, these can also be provided, in shortened finishing processes, with a paint coating, which meets the highest demands on its outward appearance on the individual component. In this case, it is particularly remarkable that the surface texture, specified according to the invention, of such a component is so fine that visually and technically sound finishing results are achieved, even when a paint system, greatly simplified in comparison to the prior art, is used.

With regard to the roll particularly suitable for producing a flat product according to the invention, the solution to the aspect specified above is achieved with a roll having a roll surface in accordance with the invention. Specifically, over a basic area of at least 0.8×0.8 $mm^2$, the roll surface after removing a possible slope in the basic area's topography, filtering out high frequency portions by means of a Gaussian low-pass filter (λs=10 μm) and determining a frequency distribution of the height values with a class size of 0.1 μm, the following applies:

a) the frequency distribution of the height values has two pronounced maxima, which equate to correspondingly pronounced peak and valley levels of the surface;

b) when just those topography regions, which have a slope of 5° at the most in relation to the vertical are observed, the frequency distribution of the height values resolve into at least two local main maxima, which local main maxima are approximately normally distributed with a standard deviation (width) of 2σ<10 μm (valleys) and a width of 2σ<1 μm (peaks);

c) frequency of valleys on the roll surface is greater than frequency of peaks on the roll surface;

d) the distance between a pronounced peak level and valley levels of the roll surface is greater than a distance between peak and valley level on the flat product surface obtained; and e) on a level, which lies exactly midway between peak and valley level, half the width of the valleys or peaks amounts to 100 μm at the most, wherein at least 99.99% of topography measurement points possess a minimum distance to the edge of the valleys or peaks, which fulfils this condition.

Finally, the invention provides a method that permits reliable production of metallic flat products, which can be simply formed and outstandingly finished.

The invention is based on the recognition that, under consideration of the criteria specified according to the invention, a metallic flat product can be systematically made available with such a fine, stochastic or quasi-stochastic surface texture that after a typical automotive paint application it is only minimally perceptible, if at all, by the human eye.

At the same time, in the case of a surface topography constituted according to the invention, the transition between the peak plateaus and the valleys takes place via steep flanks. In this way, it is achieved that the morphology of the sheet metal surface is practically independent of the actual depth of the valleys. As a result, therefore, the morphology of the sheet metal surface of a metallic flat product according to the invention is also independent of the skin-pass reduction, which is applied when the fine metal texture is produced by skin-pass rolling.

In this case, as the valleys in the surface of a flat product according to the invention are present with a defined depth, the "void" of the surface topography can be estimated in a controlled way. From this estimation, it can be determined with great accuracy what minimum amount of lubricant is needed in practice, in order to be able to form a flat product, constituted according to the invention, with minimized forming forces and optimum preservation of the surface texture.

In order to determine the flat products falling under the invention, the surface of the flat product observed in each case is examined and the surface topography determined at this time is evaluated in accordance with the following stipulations:

1. The surface topography is measured by means of a measurement system with sufficient local resolution over a basic area of at least 0.8×0.8 $mm^2$.

For this purpose measurement methods for measuring the roughness topography, which possess a local resolution of <1.5 μm (laterally) and <0.05 μm (vertically) have proven suitable.

2. If necessary, possible slopes in the topography are balanced out by suitable mathematical methods in the presently known way. Subsequent levelling of the measured topography (tilting or aligning of the entire topography) may be necessary for the evaluation, so that the peak or valley regions to be evaluated lie on one level as far as possible.

3. High frequency portions of the surface topography are eliminated by means of a Gaussian low-pass filter (λs=10 μm).

4. The frequency distribution of the peak values is calculated with a class size of 0.1 μm (shortened to "height distribution" in the following).

The surface topography of flat products according to the invention, measured and processed in this way, then fulfils the following criteria:

a) The surface possesses particularly pronounced peak and valley levels and thus has an at least two peak height distribution.

b) When just the topography regions with low inclination (inclination≤5°, that is to say, without "slope portions") are observed, the height distribution falls into at least two local "main maxima". These main maxima are distributed approximately normally with a standard deviation (width) of 2·σ<2 μm (peaks) and a width of 2·σ≤1 μm (valleys). The inclination of the flanks in this case is determined as follows:

$$\alpha=\tan-1(|\text{degree}(z(x,y))|) \text{ where } z(x,y)=\text{height}-/\text{measurement values})$$

c) The surface of the upper maximum is largest with regard to the height distribution (that is to say, peaks are more frequent than valleys).

d) The distance between the pronounced peak level and the valley levels of the roll surface is greater than the distance between peak and valley level on the flat product surface obtained.

e) On a level, which is exactly midway between peak and valley level, the half width of the valleys or peaks amounts to 100 μm at the most.

Extensive trials have confirmed that flat products produced from a steel material and constituted according to the invention are not only extremely suitable for painting but also can be formed particularly well. Roughness topographies can be adjusted in a controlled way so that the voids correspond to the lubricant quantity available. As a result, the smoothing-out process is advantageously influenced when the metal is formed (hydrodynamic lubrication). The surface quality is even and optimized, so that a paint system applied thereon also leaves behind a visual impression meeting the strictest demands, even if a costly filler coat to level out any surface irregularities has been omitted in the case of this paint system.

In order to produce a flat product according to the invention, a roll is provided according to the invention with a surface texture, which represents a negative image of the topography to be produced on the flat product according to the invention. With the measurement and evaluation conditions mentioned above for measuring and evaluating the surface of the flat product according to the invention, the following applies accordingly to the roll surface:

a) The frequency distribution of the height values has two pronounced maxima, which equate to correspondingly pronounced peak and valley levels of the surface.

b) When just the topography regions are observed, which have a slope of 5° at the most in relation to the vertical, the frequency distribution of the height values resolve into at least two local main maxima. The local main maxima are approximately normally distributed with a standard deviation (width) of $2\sigma \leq 10$ μm (valleys) and a width of $2\sigma \leq 1$ μm (peaks).

c) The frequency of the valleys on the roll surface is greater than the frequency of the peaks.

d) The main maximum representing the valleys at the same time is also an absolute maximum.

e) The distance between the pronounced peak level and the valley level of the roll surface is greater than the distance between peak and valley level on the flat product surface obtained.

f) On a level, which lies exactly midway between peak and valley level, the half width of the valleys or peaks amounts to 100 μm at the most, wherein at least 99.99% of the topography measurement points possess a minimum distance to the edge of the valleys or peaks, which fulfils the limit mentioned.

A roll with such a quality of its roll surface, coming into contact with the flat product to be processed in each case, can be produced by forming a basic structure in the roll surface by means of a suitable texturing process presently known from practice.

A possible method to adjust the roughness of the skin-pass rolls in a controlled way consists of texturing by spark erosion (electrical discharge texturing, EDT).

The starting situation before texturing the roll in this case should be a smoothly polished roll surface. Indents, which are as close as possible to each other, are shot into this surface by spark erosion. The "bridges" remaining between the indents are already at the same desired height due to the flat starting situation.

In the course of the EDT process a defined voltage is, if necessary periodically, applied briefly between electrode and roll. In this case, charge carriers (ions) are accelerated through the spark erosion channel from an electrolyte onto the roll surface. When they strike the roll surface they release roll material there and produce an indent. Typical diameters of the indents are approximately 80 μm. The released and molten metal is removed via electrode flushing and cannot rejoin the roll surface due to the dielectric oil.

However, it is not entirely possible in practice with the texturing process to prevent molten roll material from accumulating again on the original smoothly polished surface. This material can likewise be removed in the presently known way by subjecting the textured roll surface to controlled metal removal treatment, wherein the peaks of the surface texture, produced previously on the roll, are ground off above a precisely determined level. In practice, such material removal can take place, for example, by finish-grinding.

The EDT method is particularly advantageous since repeated texturing of previously textured regions is virtually impossible. The spark discharge most probably only takes place where the distance between roll surface (usually the elevation) and electrode is shortest and thus the electrical field is strongest and densest. In the places where an indent is formed by spark discharge, a further spark discharge is improbable. This permits highly dense spark discharges and a correspondingly fine roll surface texture to be obtained. The shot indents frequently "overlap". In the case of complete surface coverage, bridges now occur with different heights.

On account of the different bridge heights the textured skin-pass roll surfaces are subsequently polished by means of belt "super-finishing", in short SF. This method is covered by German Patent Application 10 2004 013 031, a European Patent Application published under the number EP 1 584 396 A2 as well as a U.S. patent application, which has been given the Ser. No. 11/082,214.

Belt super-finishing is the current technology for optimizing the smooth finish of roll surfaces. A finish which is uniform and projection-free over the entire surface is produced by the infinitely variable supply of constantly fresh abrasive. Only the highest peaks of the roll material are ground off. Subsequently, the highest bridge heights are on an almost uniform level.

Moreover, steep slope angles can be produced by belt super-finishing.

BRIEF DESCRIPTION OF THE DRAWINGS

FIG. 1 is a schematic illustration of a cutaway section through a roll surface constituted according to the present invention;

FIG. 2*a* is an Abbott Firestone curve for the surface of a product according to the present invention;

FIG. 2*b* is a height distribution curve for the surface of the same product according to the present invention;

FIG. 2*c* is a morphological height distribution curve showing the inclination of the topography in the environment of the height point for the surface of the same product according to the present invention;

FIG. 3 is a schematic diagram showing topological and morphological characteristics of the peaks and valleys of the surface of a product made according to the present invention;

FIG. 4*a* is a profile cut through the middle level of the surface of a product made according to the present invention;

FIG. 4*b* is a map of the surface distribution of the distance $r_{min}$ (minimum distance to the nearest edge (profile line)) of the surface of a product according to the present invention;

FIG. 5 is a frequency distribution of the distance $r_{min}$ to the profile line (middle level) for the surface of a product according to the present invention;

FIG. 6 is a height distribution for the surface of a thin steel sheet provided with a zinc coating made according to the present invention using a skin-pass rate of 0.6%;

FIG. 7 is a height distribution for the surface of a thin steel sheet provided with a zinc coating made according to the present invention using a skin-pass rate of 0.9%;

FIG. 8*a* is a height illustration for the surface of a thin steel sheet provided with a zinc coating made according to the present invention using a skin-pass rate of 0.9%;

FIG. 8*b* is a line profile corresponding to the height illustration for the surface of a thin steel sheet provided with a zinc coating made according to the present invention using a skin-pass rate of 0.9% of FIG. 8*b;*

FIG. 9 is a distance map of $r_{min}$ for the surface of a thin steel sheet provided with a zinc coating made according to the present invention using a skin-pass rate of 0.9%;

FIG. 10 is a graph showing the smoothing of the surface of a product made according to the present invention during forming;

FIG. 11 is a graph showing typical forming behavior (stick-slip) in the case of an insufficient oil film;

FIG. 12 is a structural spectrum for a painted product having a high quality finish;

FIG. 13 is a graph comparing the appearance of the paint finish as a function of the surface texture of the product;

FIG. 14 is an illustration showing the correlation between the sheet metal surface structure and the painted topcoat surface structure; and FIG. 15 is a graph comparing various automotive finishes on conventional sheet metal and a filler-less automotive paint finish on sheet metal according to the present invention.

DESCRIPTION

Particularly advantageously with regard to the invention, it has emerged in this connection, as schematically illustrated in FIG. 1 on the basis of a cutaway of a section through a roll surface constituted according to the invention, that steep transitions U can be obtained between the plateaus P of the "peaks" B and the soles O of the "valleys" T, as a result of controlled material removal following texturing in particular by means of belt super-finishing. As already described above, the steep slope angles β of the transitions U, produced in this way, have a substantial influence on the surface characteristics of flat products according to the invention. As a result of subsequent removal of the summits S of the surface texture obtained after texturing, it is achieved that the spatial distribution of the cavities in the later sheet metal surface is virtually independent of the skin-pass reduction used and the distance between peak and valley level. Steep slope angles are a substantial component of the surface according to the invention, so that the spatial distribution of the cavities in the later sheet metal surface is virtually independent of the skin-pass reduction used and the distance between peak and valley level.

The known method described in EP 1 584 396 A2 (belt super-finishing), with regard to the invention, has proven to be particularly advantageous.

In the case of the method according to the invention for producing a flat product according to the invention, firstly a flat product consisting of a metal material is made available, wherein at least the surface to be provided with the surface topography according to the invention has an arithmetic roughness average of 1.5 μm at the most. Subsequently, this flat product is subjected to skin-pass rolling, wherein a roll in accordance with the invention acts on the particular surface, so that a flat product is obtained, whose surface topography meets the requirements according to the invention.

In this case, it is important that the cavities, which are brought into the sheet metal surface during skin-passing by the peaks of the roll surface, as far as possible lie on a level, in order to reliably achieve the two peak height distribution of the surface topography of the flat product prescribed according to the invention.

Regarding the suitability of a flat product according to the invention for shaping, it is shown to be particularly advantageous if the surface of a flat product according to the invention is constituted so that in the case of a horizontal cut through the topography, with a material surface area of 80% at the most, the void below the cutting plane is less than 0.15 ml/m$^2$ for each measurement area. At the same time, in the case of a horizontal cut through the topography, with a material surface area of 20% at minimum, the material volume above the cutting plane should be less than 0.15 ml/m$^2$ for each measurement area. Moreover, it is advantageous in this connection if the void included below a horizontal cutting plane, with 20% material surface portion, amounts to 0.8 ml/m$^2$ at minimum. Practical investigations on galvanized steel sheet, constituted in such a manner according to the invention, have demonstrated that, when the void of the cavities brought into the respective metal sheet was divided up in this way, sufficient oil volume is always available for perfect shaping in a deep drawing tool. Thus, with this configuration of the surface texture, it can be ensured that an oil film of at least 0.7 g/m$^2$ is present in the pockets formed by the cavities of a surface structure according to the invention.

For metrological measurement and evaluation of a surface topography according to the invention, the following principles apply:

Usually, in the case of deterministic surface textures, simple geometric data are adequate to describe the essential structures with sufficient amount of information. Quasi-stochastic or stochastic surface textures, as those according to the invention, are naturally excluded from such an observation method, because form, width, height and arrangement of stochastic structures are not directly defined. On the contrary, for a comprehensive mathematical description of deterministic to stochastic surface topographies, the use of statistical methods or statistical image processing is required.

a) Frequency Distribution of the Height Values ("Height Distribution")

A popular feature in the statistical description of surface topographies is the frequency distribution of their measured or mathematically generated height values, in short: height distribution. A further common designation for the "frequency distribution of height values" is the amplitude density curve (see DIN EN ISO 4287).

The height distribution (FIG. 2*b*) indicates with what frequency a certain height value can be found again in the surface topography. It arises as a result of calculating ("deriving") the differences from the material percentage curve, also known as Abbott Firestone Curve (DIN EN ISO 4287) (FIG. 2*a*).

In order to determine the height resolution, the height scale is divided into discrete ranges (so-called "classes"). The class size in this case is to be selected so finely that the height distribution can be reproduced with sufficient resolution. In order to be able to determine only the "main" maxima or minima in a height distribution, by way of contrast, only a correspondingly rough class size of, for example, 0.2 μm is advantageous. Because through this negligible local maxima and minima are eliminated as a result. In order subsequently to be able to calculate the width of these main maxima and minima as well as their exact position, a fine resolution (0.1 μm for example), which should be three times less than the half widths of the maxima or minima (Nyquist theorem), is again advantageous.

Various data about a surface topography initially remain concealed in a height distribution. This will be explained on the basis of the following example:

Only for simple geometric objects is it possible to directly read off the inclination of the "slopes" in the region of the transitions from a "peak" to a "valley" of the surface texture (or calculation of the flank angles) from the height distribution. In order to describe complex surface topographies, it is therefore expedient to differentiate in what vicinity a topography point is located and to classify the height value for the frequency distribution accordingly. A significant feature in this case is the inclination of the topography in the environment of the height point (FIG. 2*c*).

Another criterion of distinction is offered by the curvature of the surface topography, due to the fact that local maximum ("peaks"), saddle (turning points) and minimum ("valleys") portions are separated from each other (in FIGS. 2*a*-2*c*, however, this is not illustrated). As the height values are differentiated according to the inclination, it is possible in the height distribution to verify whether for example peak and valley portions (with a slope of <5°) in each case are on one level or otherwise.

In metrological practice a certain "fuzziness" always exists in the height values. In particular erroneously, this fuzziness can also be due to a slope in the topography. In order to be able to derive significant information about the topography from the height distribution, it is therefore expedient to generally minimize possible inclinations beforehand by aligning the total topography. The fuzziness in the determination of the peak and valley levels can be approximately described by a normal distribution. For the surface topography according to the invention, the standard distribution a of the corresponding normal distribution should not exceed an upper limit (FIG. 3).

In FIG. 3 by way of example, a line profile is illustrated with its corresponding height distribution (with narrow angle of inclination) as an example. The distance between the two local maxima in the height distribution is marked with "T". Accordingly "T/2" is the half distance.

b) Surface Area Distribution

The surface area distribution of the topography portions, such as peaks or valleys, can be described on the basis of a profile cut. In this case, it is differentiated, by means of a threshold operation, whether a measurement point "z" lies above or below a certain height level (threshold $z_h$). Accordingly, a binary pattern ("bright", "dark") develops, as illustrated in FIG. 4. In practice, common height levels are the arithmetic average, median (median cut, height values for equal portions are located above or below the threshold in each case) and half maximum or minimum values. The latter serve to determine so-called half widths (FWHM=full width at half maximum/minimum).

The edges of the light/dark pattern directly provide the profile line, whose length related to the measurement surface observed, serves to measure the precision of the surface. That is to say, finer surface textures have large profile lengths. This characteristic value is similar to the peak number of RPc according to DIN EN 10049, which, however, uses two threshold operations (two height levels at the distance $[C_s]$= 0.5 μm of the arithmetic average). Complete information about the arrangement and size of the light/dark patterns however is not supplied by both characteristic values.

A metal sheet flat product according to the invention is marked by a characteristic height distribution with two distinctive maxima, which are also called peak and valley levels here. An excellent cutting plane is the average level between peak and valley level.

A simple operation in order to determine the "half width" of the peaks or valleys (HWHM=half width at half maximum) consists in calculating the minimum distance $r_{min}$ to the nearest edge (profile line) (FIG. 4*a*). The distance to the profile line $r_{min}$ is defined here as negative if it was determined in regions below the threshold value ("dark pattern", valley region). As a result, simultaneous illustration and evaluation of all $r_{min}$ values are possible (FIG. 4*b*).

In the case of stochastic surfaces of the type according to the invention it is not expedient, due to existing statistical fluctuations, to set the permissible upper and lower limits for $r_{min}$ absolutely. It is more expedient rather to observe the frequency distribution of $r_{min}$ (FIG. 5).

The frequency distribution of $r_{min}$ can be described here (FIG. 5) approximately by an asymmetrical normal distribution. That is to say, the standard deviations $\sigma_1$ and $\sigma_2$ are different on the "right" and "left" of the maximum (most frequent value, also known as "mode"). In this case, it is not essential that the most frequent value of the frequency distribution coincides with the ordinate.

The distance of the mode to the ordinate here is called "m". $3\sigma_1-m$ or $3\sigma_2+m$ are good measures for the left or right limits of $r_{min}$ in the frequency distribution. This means that more than 99.99% of the calculated $r_{min}$ values (in the case of asymmetrical normal distribution) are within these limits.

FIGS. 6 to 9 reproduce thin steel sheets constituted according to the invention provided with a zinc coating as typical examples of the "height distributions" (FIGS. 6, 7), "surface area distributions of the height values" (FIGS. 8*a* (height illustration), 8*b* (line profile)) determined in the way described above in principle and as an example of typical distance mapping (FIG. 9).

Each of the measurement and analysis results shown in FIGS. 6-9 was determined on sheet metal specimens, which were subjected to skin-pass rolling with a roll, whose corresponding surface texture has been produced in the way described above, known from EP 1 584 396 A2, by electrical discharge texturing (in short "EDT") with subsequent fine-grinding. The skin-passing rate in the example shown in FIG. 6 in this case was 0.6%, while in the examples shown in FIGS. 7 to 9 it was 0.9% in each case.

FIG. 8*a* shows the surface, measured in each case, in a height illustration, whereas FIG. 8*b* shows the line profile corresponding to this illustration.

The effects of a surface quality according to the invention on the forming behavior and the appearance after paint finishing are described in detail below:

The surface of a flat product according to the invention in its precision shape is characterized by cavities, which are very evenly and finely distributed and possess a clearly defined maximum depth in a surface, which is otherwise as smooth as possible. These cavities, when a metal sheet according to the invention is formed into a component, serve as a lubricant reservoir during tribological contact between tool and metal sheet. Particularly deep crater structures, which would only show an effect in the case of surface levelling to a correspondingly strong degree, are avoided with a flat product according to the invention, since they would only form redundant lubricant sinks.

Also, from a paint technological aspect, deep and broad craters in the sheet metal can only be leveled out at great expense by a multi-coat paint system. The cavities brought into a sheet metal surface according to the invention, on the contrary, are nearly entirely on a level and drastically reduce long waviness structures already existing beforehand, which, for example, can arise as the result of a metal coating.

For shaping sheet metal into components, defined friction conditions in the metal-working tool are essential. As little friction and thus as unhindered flow of material as possible are required at critical regions such as die or tool edges, since usually high surface pressures and high relative velocities between tool and sheet metal surfaces can occur here at the same time. A reduction of the friction at these places in particular permits higher output rates and better utilization of production capacities.

On the contrary, high friction is essential within such regions, where hardly any flow or thinning of the material (for example, deep-drawing under the tool) is desired.

Possibilities for adjusting these tribological conditions are provided by corresponding choice of the material combination (such as coating of metal-working tools), lubricant and process parameters (such as restraining forces).

In the past, attempts have been made to adjust the process window as accurately as possible by setting as narrow as possible tolerances for fabricating the metal sheets. Values for characterizing the sheet metal surface in particular were the arithmetic roughness average Ra and peak value RPc (see ISO EN 10049). In this case, sheet metal surfaces with a high roughness average Ra were usually required in order to achieve optimum forming results.

Practical experience, however, has shown that surfaces can behave very differently despite similar characteristic values Ra and RPc. Subsequent adaptation of the process parameters (such as lubrication) to production-induced fluctuations in the roughness of the flat product is therefore hardly applied in practice.

As a result of the clearly defined topography of the flat product and morphology, flat products with a surface finish according to the invention now make it possible for forming processes to be adjusted in a more controlled way.

Comparison of ACTUAL and TARGET surface topographies of the flat product can serve to optimally adjust the process parameters. In particular, critical shaped parts can thus be produced for longer and with lower failure rates.

The structural elements of the roughness structure in particular act as a reservoir for the lubricant (void, FIG. 10) and thus facilitate its retention and distribution during shaping. During the forming process smoothing-out of the metal surface topography takes place as a result of the tool contact (local surface pressure in some cases>300 MPa). This reduces the original void volume (FIG. 10). Thus, the lubricant included in the topography is either consolidated or displaced, and hydrostatic or hydrodynamic lubrication of the contact area then takes place.

It is problematic if the void is not filled with sufficient lubricant. Then the effect becomes negative. The lubricant is displaced from the contact areas between tool and metal sheet into the not yet sufficiently filled valleys. Under heavy tribological stress the lubricant film then tears and forming of the metal fails due to dry friction or cold welding (zinc abrasion from the metal sheet in the press). FIG. 11 shows typical forming behavior (stick-slip) in the case of an insufficient oil film.

Depending on tool geometry (regions with high and low surface pressure) and tribological stress (such as relative velocities) both open and closed voids must be sufficiently filled with lubricant.

Experience over many years has shown that lack of lubricant is one of the most frequent causes of metal-forming problems. This practical experience substantiates the recognition, on which the invention is based, that the valleys of the surface texture according to the invention should possess a depth as uniform (and also smaller) as possible. The surface, on the other hand, should be far more supportive. Moreover, the void provided for the lubricants should be limited in each case.

Previously, the quality of a paint finish was judged purely by subjective yardsticks. Later, reference sample panels were used in order to characterize different paint finishes.

For some years, however, the DOI wavescan measuring instrument supplied by the Byk-Gardner Company has been established as the "appearance standard"; this is used by all European and throughout the world by nearly all car manufacturers for characterization and qualitative evaluation of standard automotive finishes. The DOI wavescan instrument among other things measures the following values:

DOI (=Distinction of Image), meaning no more than the sharpness of an image reflected by the paint), short wave (SW) and long wave (LW) as well as the waviness parameters du, Wa, Wb, Wc, Wd and We.

In the case of DOI, the higher the value determined, the better the quality of the painted surface. For all other values, however, the lower the better.

The appearance of a paint finish is constituted by brilliance, DOI and waviness. The latter can show up as so-called "orange peel", which is visible when looking at the paint surface itself.

Short-wave structures are best recognized at a distance of 40 cm, these structures (fine-particle, fuzzy) being measured with a short wave (SW) parameter. 40 cm corresponds approximately to the viewing distance when cleaning the car by hand.

Long-wave structures, on the other hand, are best recognized at a distance of 3 meters. These structures (orange peel, long wave) are measured with the long wave (LW) parameter. The distance of 3 meters corresponds to the view in the showroom (showroom distance).

The DOI wavescan instrument uses a laser and a sensor to measure an optical profile of the surface. This is divided up by mathematical filters into wavelength ranges. Prior art is division into six waviness parameters: du (<0.1 mm, "dullness"), Wa (0.1-0.3 mm), Wb (0.3-1 mm), We (1-3 mm), Wd (3-10 mm) and We (10-30 mm).

The measurement range ranges from 0 (smooth) to 100 (heavy texture) in each case. The values measured are dimensionless.

The measurement values are plotted over the wavelength ranges, which results in a structural spectrum, as illustrated, by way of example, for a high-quality surface in FIG. 12.

The invention is therefore based on the premise that the quality of the paint finish can be positively affected by specifically adjusting the surface texture. Thus, structures of <0.1 mm (du) produce lower contrast of the paint finish by light refraction. Structures from 0.1 to 1 mm (Wa, Wb) lead to fuzziness of the profile lines in the paint reflection.

An automotive paint finish meeting normal requirements has a DOI value of at least 85. In the case of very good paint finishes, the DOI value is in the range of 90-95. In the case of good quality paint finishing of a metal sheet according to the invention, this range can be achieved even if the process employs a paint film thickness, which is considerably reduced in relation to the prior art (filler-less process). Thus, for painted metal sheet according to the invention, DOI values of at least 94 were achieved without a filler coat being needed.

Good quality paint finishes have SW values (short-waviness) of <25 in the case of horizontal paint application. Their LW values (long-waviness) lie at <8 in the case of horizontal paint application.

The gloss of an automotive paint coating is measured at an angle of 20° to the surface and, virtually irrespective of the DOI and waviness parameters, achieves equally high values in the case of good and bad paint finishes. The gloss mainly depends on the finishing system and painting process parameters and allows no conclusion as to a good or bad paint finish.

A paint finish is generally considered good if it corresponds to the master curve shown in FIG. 12. In this case, the following indications generally apply:

No waviness measurement greater than 30.

Ideal value for Wb/Wd of 1.5 ("long wave coverage", overlap of long-waviness)

Ideal value for Wd/We of >1 ("wet look")

The graph curve should have a double hump ("camel back").

du and Wa can be slightly increased in order to mask orange peel.

Textured sheet metal surfaces mainly affect the Wb value. This is typically the waviness parameter with the highest numerical value and should be as low as possible (FIG. 13). For good paint finishes, the Wb value should be less than 30.

The quality of the sheet metal surface also has less influence on the parameter Wa. Very rough metal sheets negatively affect the parameters Wc and even Wd. In the case of such flat products, too high measurements, which are more difficult to correct from a paint technological aspect, are then obtained.

Also, the paint finish can affect the waviness parameters. The clear coat or its application has an influence on the waviness values du (clear coat too milky, dry spraying of the clear coat), Wc, Wd (clear coat too thin). Cataphoretic painting coat and filler coat with rough application or lack of flatting can considerably increase the Wb value. The Wc value is increased by flatting marks or dry spraying of the filler.

Generally, metal sheets to be painted with consistent roughness, defined within narrow tolerances, and optimized texturing should be used as far as possible. The painting process with its numerous parameters and optional procedures must be kept as constant as possible by the OEM in order to achieve quality, colour matching and, in the case of modern paints with special effect pigments, the same or very similar effect from car body to car body.

A low Wb value, in particular with regard to plastic components, is an important factor for a painted metal sheet. Plastic parts only have very little roughness, so that very low Wb values and very flat structural spectra are achieved. This can be perceived as especially negative, if too smooth painted plastic parts sit on the car body next to a too rough painted metal surface. When looking at the car body such a "visual break" is noticeable in the overall paintwork, which is undesirable. As a result of surface roughness or waviness already imparted by the form-giving injection moulding at the plastic component manufacturers, the waviness of the painted plastic components is matched to the waviness of the painted metal components.

Here, the texturing according to the invention of the sheet metal surface offers the possibility of producing metal sheets with a lower Wb value after paint finishing, which can provide a better visual match next to painted plastic components. Particularly in the case of high-quality motor vehicles, there is now more than ever the trend towards a so-called "piano finish". This means a highly reflective paint finish with very good DOI values and very low waviness, the model for which is a shiny black lacquered grand piano.

Thus, a paint finish is normally to be obtained only by repeated flatting and lacquering. Furthermore, in the case of luxury, upper and middle class motor vehicles a trend towards the use of large-surface glass roofs can be recognized. These are sometimes darkly tinted and usually painted black around the edge in order to conceal the adhesive join on the rear. Due to the extreme, reflective smoothness of a dark glass roof, it is particularly difficult here to match the paint finish of the adjacent metal components such as roof frame or roof paneling. This problem can also be surmounted by using flat products according to the invention.

An ideal painting substrate is even and has no roughness or surface irregularities. This is technically difficult to achieve with sheet metal, since generally the surface has to be formed into a component. For shaping, oil retention capacity, which, however, requires a certain roughness/surface topography of the even metal sheet, is necessary for the lubrication.

In FIG. 13, with regard to a metal sheet with too rough texturing (broken line), a metal sheet with standard texturing (dash-dotted line) and a metal sheet according to the invention (continuous line), the measurement values determined for the paint appearance are plotted as a function of the surface topography. It is evident that in the case of disadvantageous coarse texturing, the value for Wb rises considerably and, after cataphoretic paint coating and filler coating, causes a worse paint finish or increased flatting requirement. It is equally evident that, in contrast, for the forming process the texturing according to the invention permits an improved paint finish with reduced Wb values.

With a surface texture according to the invention, an optimum compromise has been found, since both on the plateaus, as well as in the cavities, large even regions, which are only separated from each other by short but steep flanks, are present here on a level. The number of uneven portions on the surface, negatively affecting the general impression, is thus reduced to a minimum in the case of a flat product according to the invention.

The paint finish reflects the substrate to some degree and exaggerates any unevenness. The interdependence of sheet metal structure/paint structure is illustrated in FIG. 14.

FIG. 15 shows a bad automotive paint finish involving a filler coat (dotted line), a normal (broken line) and a good (dash-dotted) automotive paint finish compared with a painted metal sheet according to the invention without filler coat (continuous line). The waviness Wb, considerably reduced in relation to normal automotive paint finishes, which leads to improved gloss and higher DOI values, can be clearly seen here.

The structural spectrum of the metal sheet according to the invention in the case of the example for the Wb value, illustrated in FIG. 15, lies slightly above the curve for a good automotive paint finish and shows lower values for the Wd value. This is due to the paint system selected for the texturing according to the invention. In order to allow the texturing/structure of a metal sheet to stand out to the maximum for the Wb value, the application of filler (approx. 35 μm film thickness) was completely omitted. Also, instead neither a special filler-less painting concept was employed, nor was the cataphoretic paint coating flatted.

Despite these intensified conditions the metal sheet constituted according to the invention demonstrates a painting result which is comparable with a good automotive paint finish.

Because a thicker clear coat was applied on the metal sheet according to the invention, any influence of the paint finish on the waviness parameters Wd could be totally prevented (thin clear coats result in higher Wd values). Also, this allows the variations of the texturing to clearly stand out. In the structural spectrum, a value for Wd, lower than for a good automotive paint finish, is to be seen here. The metal sheet according to the invention thus reduces the Wd value in relation to the Wd value which can be determined for standard texturing.

In order to achieve a desired painting result with Wd/We ratios as in the master curve on FIG. 12, only the clear coat thickness must therefore be adjusted.

The texturing of a flat product according to the invention thus leads, even with the omission of a filler coat, to a good painting result having good values for Wb and DOI. Simultaneously, it reduces the value for the long-waviness Wd in relation to standard texturing, as a result of which the formation of orange peel is minimized.

Metal sheets constituted according to the invention are thus suitable preferably for the use of such paint concepts, wherein filler application and subsequent flatting of the filler coat are dispensed with. The invention thus fulfils the need for sheet metal substrates, especially in the motor vehicle manufacturing industry, which permit a shorter painting process at the same time with outstanding usage properties and appearance.

The invention claimed is:

1. A flat product made of a metal material for whose surface, over a basic area of at least 0.8×0.8 $mm^2$, after removing a possible slope in the basic area's topography, filtering out high frequency portions by means of a Gaussian low-pass filter (λs=10 μm) and determining a frequency distribution of the height values with a class size of 0.1 μm, has:

a) the frequency distribution of the height values has two pronounced maxima, which equate to correspondingly pronounced peak and valley levels of the surface;

b) when just those topography regions, which have a slope of 5° at the most in relation to the basic area (horizontal) are observed, the frequency distribution of the height values resolve into at least two local main maxima, a peak main maximum and a valley main maximum; which local main maxima are substantially normally distributed with the peak main maximum having a standard deviation of 2σ≤2 μm and the valley main maximum having a standard deviation of 2σ≤1 μm;

c) frequency of peaks is greater than frequency of valleys;

d) the peak main maximum is also an absolute maximum;

e) a difference between the peak main maximum and the valley main maximum is 1 μm-5 μm; and f) on a level, which lies exactly midway between the peak main maximum and the valley main maximum, the half width of the valleys is 40 μm-100 μm and the half width of the peaks is 40 μm-100 μm, wherein at least 99.99% of topography measurement points possess a minimum distance to the edge of the valleys or peaks of 40 μm-100 μm.

2. Flat product according to claim 1, wherein the product is a steel sheet or strip.

3. Flat product according to claim 1, wherein the product is a steel sheet or strip having a surface comprising a corrosion protective layer.

4. Flat product according to claim 3, wherein the corrosion protective layer is a coating based on zinc.

5. Flat product according to claim 1, wherein the product is coated with a paint finish.

6. A roll for producing flat products formed according to claim 1, wherein for the surface of the roll, over a basic area of at least 0.8×0.8 $mm^2$, after removing a possible slope in the basic area's topography, filtering out high frequency portions by means of a Gaussian low-pass filter (λs=10 μm) and determining a frequency distribution of the height values with a class size of 0.1 μm, the surface of the roll has:

a) the frequency distribution of the height values has two pronounced maxima, which equate to correspondingly pronounced peak and valley levels of the surface;

b) when just those topography regions, which have a slope of 5° at the most in relation to the vertical are observed, the frequency distribution of the height values resolve into at least two local main maxima, a peak main maximum and a valley main maximum, which local main maxima are approximately normally distributed with the valley main maximum having a standard deviation of 2σ≤10 μm and the peak main maximum having a standard deviation of 2σ≤1 μm);

c) frequency of valleys on the roll surface is greater than frequency of peaks on the roll surface;

d) the valley main maximum is also an absolute maximum;

e) a difference between the peak main maximum and the valley main maximum of the roll surface is greater than a difference between the peak main maximum and the valley main maximum on the flat product surface obtained; and f) on a level, which lies exactly midway between the peak main maximum and the valley main maximum, the half width of the valleys is 100 μm at the most and the half width of the peaks is 100 μm at the most, wherein at least 99.99% of topography measurement points possess a minimum distance to the edge of the valleys or peaks of 100 μm at the most.

7. A method for producing a flat product formed according to claim 1, wherein a flat product consisting of a metal material is made available, wherein at least a surface to be provided with the surface topography has an arithmetic roughness average of 1.5 μm at the most, and the flat product made available is subjected to skin-pass rolling, wherein a roll having a roll surface acts on the surface to be provided with the surface topography, wherein the roll surface over a basic area of at least 0.8×0.8 $mm^2$, after removing a possible slope in the basic area's topography, filtering out high frequency portions by means of a Gaussian low-pass filter (λs=10 μm) and determining a frequency distribution of the height values with a class size of 0.1 μm, is defined by:

a) the frequency distribution of the height values has two pronounced maxima, which equate to correspondingly pronounced peak and valley levels of the surface;

b) when just those topography regions, which have a slope of 5° at the most in relation to the vertical are observed, the frequency distribution of the height values resolve into at least two local main maxima, a peak main maximum and a valley main maximum, which local main maxima are approximately normally distributed with the valley main maximum having a standard deviation of 2σ≤10 μm and the peak main maximum having a standard deviation of 2σ≤1 μm;

c) frequency of valleys on the roll surface is greater than frequency of peaks on the roll surface;

d) the valley main maximum is also an absolute maximum;

e) a difference between the peak main maximum and the valley main maximum of the roll surface is greater than a difference between the peak main maximum and the valley main maximum on the flat product surface obtained; and f) on a level, which lies exactly midway between the peak main maximum and the valley level main maximum, the half width of the valleys is 100 μm at the most and the half width of the peaks is 100 μm at the most, wherein at least 99.99% of topography measurement points possess a minimum distance to the edge of the valleys or peaks of 100 μm at the most.

* * * * *